United States Patent [19]

Reavis, Jr. et al.

[11] 4,186,984

[45] Feb. 5, 1980

[54] STRAIN RELIEF COVER FOR A BARREL TERMINAL

[75] Inventors: Robert P. Reavis, Jr., Statesville; Melvin A. Soderstrom, Advance; Vasantrai A. Vachhani, Kernersville, all of N.C.

[73] Assignee: AMP Incorporated, Harrisburg, Pa.

[21] Appl. No.: 903,367

[22] Filed: May 5, 1978

Related U.S. Application Data

[63] Continuation-in-part of Ser. No. 857,068, Dec. 5, 1977, Pat. No. 4,141,618.

[51] Int. Cl.[2] ..... H01R 13/58

[52] U.S. Cl. ..... 339/103 R; 339/258 RR

[58] Field of Search ..... 339/103, 97 R, 97 C, 339/98, 99 R, 258 RR

[56] References Cited

U.S. PATENT DOCUMENTS

| | | | |
|---|---|---|---|
| 3,845,455 | 10/1974 | Shoemaker | 339/97 R |
| 3,897,128 | 7/1975 | Reavis, Jr. | 339/98 |

*Primary Examiner*—Roy Lake
*Assistant Examiner*—DeWalden W. Jones
*Attorney, Agent, or Firm*—Gerald K. Kita

[57] ABSTRACT

The disclosure relates to an insulation cover for a slotted barrel electrical terminal of the type mounted to a printed circuit board. The cover is molded of dielectric material in cylindrical form with an open end for receipt over a barrel terminal, and a closed end which is slotted to provide a seat against which an insertion tool is registered. A lengthwise slot of the cover receives one or more wires therein and grips across the cross section of each received wire to provide a strain relief. A projecting tab on the cover is utilized for gripping when removal of the cover from the terminal is required.

2 Claims, 7 Drawing Figures

Fig. 1
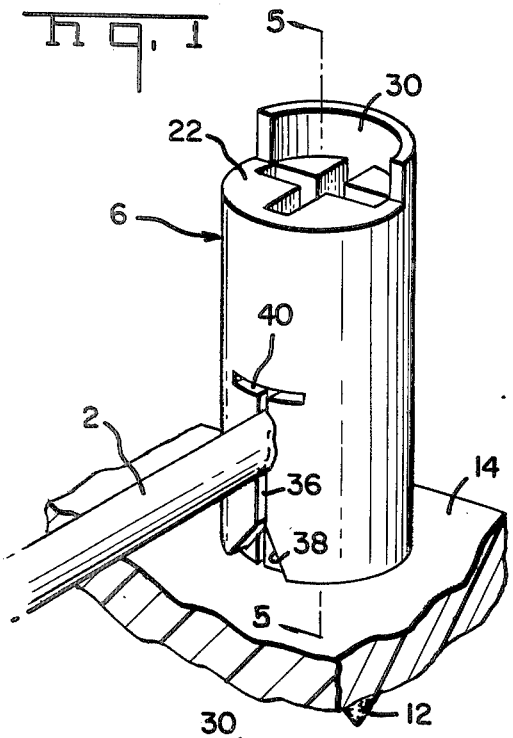
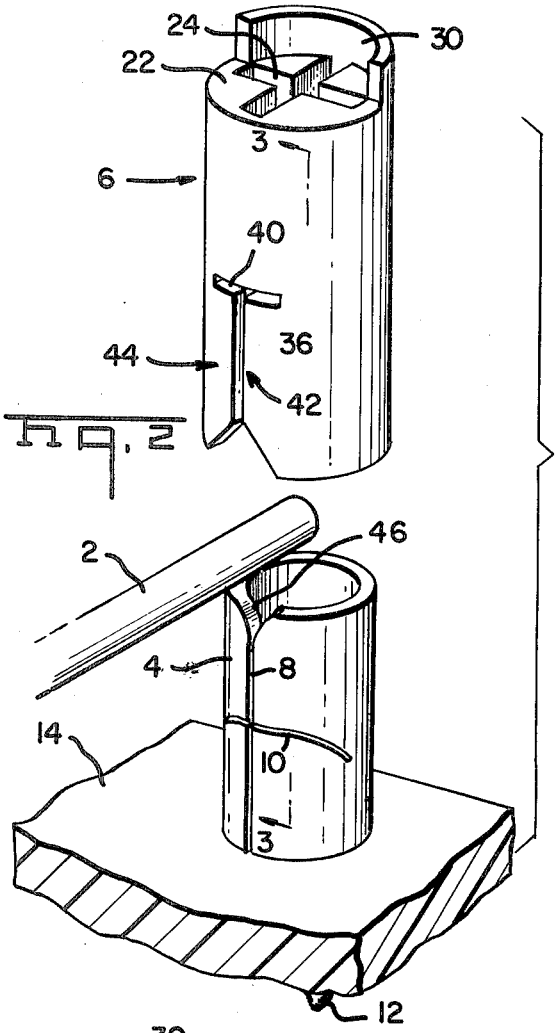
Fig. 2
Fig. 3
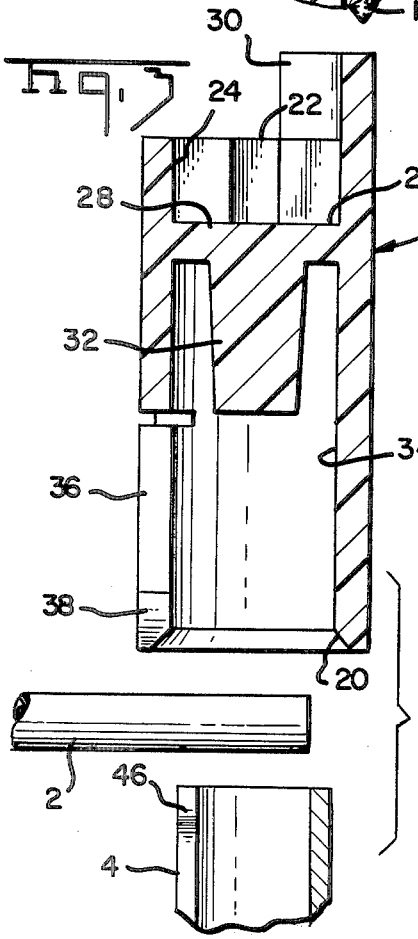
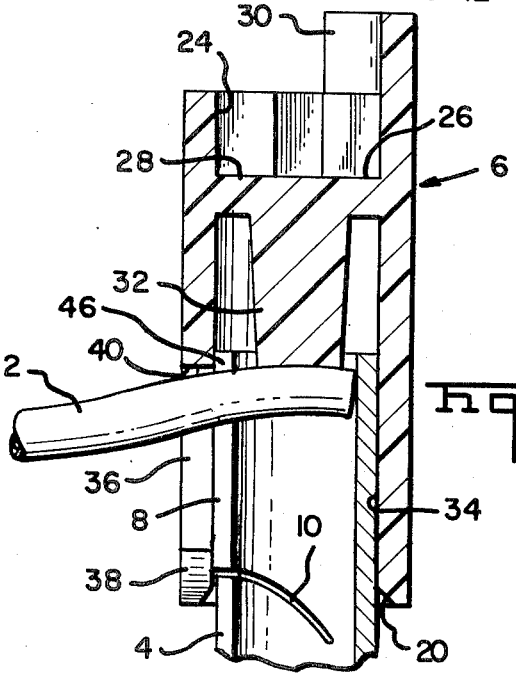
Fig. 4

STRAIN RELIEF COVER FOR A BARREL TERMINAL

CROSS REFERENCE TO RELATED APPLICATION

This application is a continuation-in-part of U.S. Application Ser. No. 857,068, filed Dec. 5, 1977 and now U.S. Pat. No. 4,141,618.

BACKGROUND OF THE INVENTION

A transversely slotted barrel terminal is disclosed in U.S. Pat. No. 4,141,618. The terminal is provided with a longitudinal wire receiving slot which is bifurcated by a transverse slot to divide the terminal into a pair of wire receiving and gripping electrical contact portions. One or a pair of wires are electrically connected in the wire receiving slot.

BRIEF DESCRIPTION

The present invention relates to a molded dielectric cover for a transversely slotted terminal which may or may not have a transverse slot as above described. The cover includes a wire receiving slot for gripping one or more wires which protrude from the barrel terminal providing a strain relief for the wires. The cover includes a stuffer which enters the barrel terminal during assembly of the cover thereto. The stuffer is utilized to insert a wire into the terminal simultaneous with such assembly. An appendage on the cover is gripped by pliers in order to remove the cover from the terminal. A closed end of the cover is provided with intersecting narrow recesses which serve as a seat for a standard or Phillips type screwdriver.

OBJECTS

An object of the present invention is to provide a dielectric cover for a slotted barrel terminal which incorporates a wire strain relief and wire stuffer.

Another object of the present invention is to provide a cover for a slotted barrel terminal which has a wire receiving slot for gripping and providing strain relief for one or more wires connected to the barrel terminal, the cover further being provided with a closed end provided with a tool receiving seat and a tool gripping appendage.

Other objects and advantages of the present invention will become apparent from the following detailed description taken in conjunction with the drawings.

DRAWINGS

FIG. 1 is an enlarged fragmentary perspective of a cover assembled over a barrel terminal and providing strain relief for a wire connected electrically to the terminal.

FIG. 2 is an enlarged fragmentary perspective similar to FIG. 1 illustrating the parts in exploded configuration.

Figure 5:
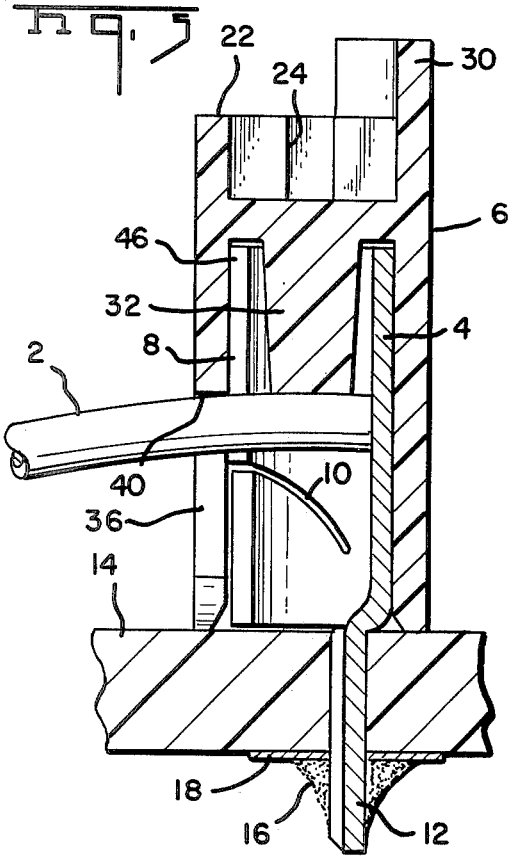

FIGS. 3, 4, and 5 are enlarged fragmentary elevations in section illustrating various stages of assembly of a wire and a cover with a slotted barrel terminal.

Figure 6:
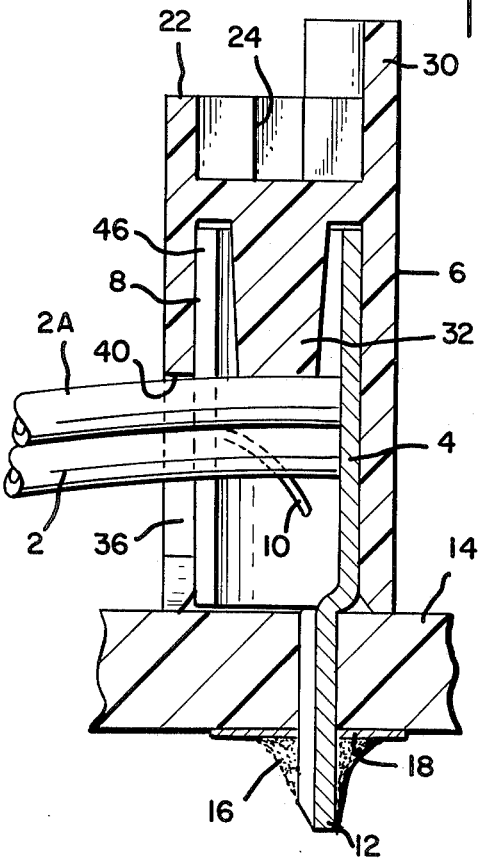

FIG. 6 is an enlarged elevation in section illustrating the assembly of a cover and two wires in a transversely slotted barrel terminal.

Figure 7:
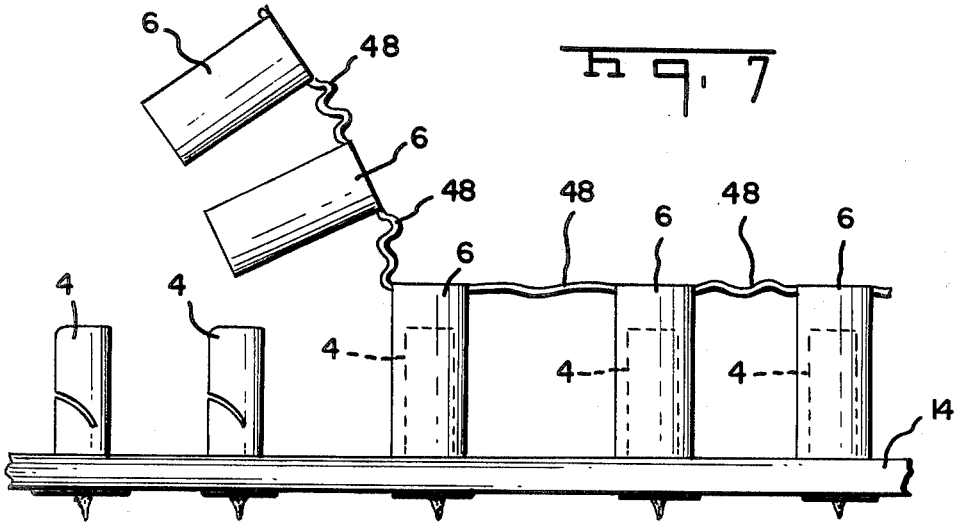

FIG. 7 is a diagrammatic view illustrating a series of interconnected covers for assembly over barrel terminals having varied spacing therebetween.

DETAILED DESCRIPTION

With more particular reference to FIGS. 1, 2, and 3, there is shown generally at 1 an assembly of an insulation covered wire 2, a slotted barrel terminal 4, and dielectric cover 6 also serving as a wire inserter and strain relief. The terminal 4 is of the type described above as being of generally cylindrical configuration having a longitudinal slot 8 and a transverse slot 10 which bifurcates the terminal 4 into two, wire-receiving and connecting contact portions. The terminal includes an integral depending narrow stake or tail 12 which projects through a printed circuit board 14 and is soldered at 16 to a circuit path 18 of the board 14. The cover 6 is generally of cylindrical sleeve configuration and is molded in one piece from a suitable stiffly flexible dielectric material. The cover 6 includes an opened end 20 and a closed end defined by an end wall 22. The end wall 22 includes a generally cross shaped recess 24 terminating at a bottom wall 26 defining a transverse solid web 28. The end wall 22 further includes an outwardly projecting appendage 30 which advantageously conforms to the cylindrical configuration which is provided to conform closely to the periphery of the terminal 4, thereby, permitting close spacing of adjacent terminals, together with their covers 6 on the circuit board 14. Integral with the web 28 is an inverted, generally frustoconical wire stuffer 32 which is internally spaced from, and concentric generally with, the outer cylindrical sidewall 34 of the cover 6. The cover 6 further is provided with a longitudinal slot 36 having an enlarged flared entryway 38 communicating with the open end 20. The slot 36 terminates at its outer end in a generally transverse slot 40. As shown in FIG. 2, the slots 38 and 40 provide a pair of stiffly flexible opposed flaps 42 and 44 on either side of the slot 36.

During assembly of the cover 6 over the terminal 4, together with an insulated wire 2, the cover is shown in FIGS. 3 and 4 as having the slot 38 aligned with the slot 8 and receiving the wire 2, first, into the flared entryway 38, and then lengthwise along the slot 36, as the cover is progressively received concentrically over the terminal 4. As shown in FIG. 4, the wire 2 is already gripped by the flaps 42 and 44 on either side of the slot 36 which has received the wire therein. The transverse slot 40 provides a positive stop to limit wire travel along the slot 36. The cover is already partially assembled over the terminal 4, and the wire 2 is in registration with an enlarged flared entryway 46 for the slot 8. In addition, the stuffer 32 impinges against the wire 2, the end of which projects into and is contained within the cylindrical confines of the terminal 4. Further assembly of the cover 6 in telescoped relationship over the terminal 4 will force the stuffer 32 internally of the cylindrical terminal 4, stuffing the wire 2 progressively along the slot 8 until it is in registration along the slot 8 just above the transverse slot 10 as shown in FIG. 5. The wire is held in position by the stuffer 32 and the slot 40. The flap portions 42 and 44 resiliently grip the wire 2 across the cross section thereof to provide a strain relief and to prevent pull out or breakage of the wire where gripped by the terminal 4. The wire 2 is prevented from traversing further along the slot 8 and past the transverse slot 10 because the top portion of the terminal will radially expand as shown in FIG. 5 as compared with the bottom portion of the terminal 4. The presence of the transverse slot 10 thereby allows independent radial expansion of the top and bottom portions of the terminal. Any tendency for the wire to traverse further downwardly in the slot 8 will cause the wire to impinge against the smaller diameter bottom portion of the terminal.

FIG. 6 illustrates the assembly comprising the cover 6 together with the wire 2 and another wire 2A. Such an assembly is accomplished first by inserting the wire 2 shown in FIG. 5, followed by removing the cover 6 from the assembly, and then reassembling the cover 6 together with a second wire 2A. For example, the cover is removed by gripping the appendage 30, with a suitable tool such as a pair of pliers. Reassembly of the cover over the terminal 4, which already has the wire 2 terminated thereto, is accomplished as described with respect to FIGS. 3, 4, and 5, with the exception that wire 2A is assembled simultaneously with the cover 6. As shown in FIG. 6, the stuffer 32 and the transverse slot 40 will engage transversely the wire 2A and force the same into and along the slot 8. Since the wire 2 is already in the slot 8, the wire 2A will transversely impinge the wire 2 and force it further along the slot 8 past the transverse slot 10. In the final assembly, wires 2 and 2A will be electrically terminated when received in the slot 8, and be disposed along the slot 8 but on opposite sides of the transverse slot 10. The bottom as well as the top portions of the terminal will then radially expand in response to the presence of the wire in slot 8. To assist in assembly of the cover 6 either a Phillips or standard screwdriver may be placed in registration within this slot 24 which provides a seat for the screwdriver, maintaining alignment of the screwdriver colinearly with the terminal 4 and cover 6.

FIG. 7 illustrates a plurality of terminals 4 on different relative adjacent spacings on the circuit board 14. A series of covers 6 are interconnected by strip form dielectric webs 48 which may be molded integral with the series of covers 6. The webs are made relatively thin to be flexible and to allow deformation thereof by wrinkling or even stretching to bridge between different spacings of the covers 6.

Although a preferred embodiment of the present invention is disclosed in detail, other modifications and embodiments which would be obvious to one having ordinary skill in the art are intended to be covered by the spirit and scope of the appended claims.

What is claimed is:

1. A wire inserter and strain relief cover for a slotted barrel terminal comprising:

a sleeve of dielectric material having a closed end and an open end, said closed end including a pair of intersecting recesses, said sleeve having a lengthwise wire receiving slot communicating with said open end and extending toward said closed end and terminating in a transverse slot, said wire receiving slot having an enlarged flared entryway communicating with said sleeve open end, and a projecting portion on said closed end internally of said sleeve and concentric therewith, whereby said projecting portion engages a wire entering into said wire receiving slot and into an open end of a slot provided longitudinally in a barrel terminal which is to be covered by said cover.

2. The structure as recited in claim 1, wherein, said closed end is provided with an integral projecting appendage.

* * * * *